US006874855B2

(12) United States Patent
Nivet

(10) Patent No.: US 6,874,855 B2
(45) Date of Patent: Apr. 5, 2005

(54) METHOD FOR MANAGING THE CONTROL SYSTEM OF A SEAT WITH PRE-PROGRAMMED POSITIONS AND SEAT THEREFOR

(75) Inventor: Laurent Nivet, Asnieres (FR)

(73) Assignee: Labinal, Montigny-le-Bretonneux (FR)

( * ) Notice: Subject to any disclaimer, the term of this patent is extended or adjusted under 35 U.S.C. 154(b) by 0 days.

(21) Appl. No.: 10/019,628

(22) PCT Filed: May 2, 2001

(86) PCT No.: PCT/FR01/01341

§ 371 (c)(1),
(2), (4) Date: Jan. 3, 2002

(87) PCT Pub. No.: WO01/82751

PCT Pub. Date: Nov. 8, 2001

(65) Prior Publication Data

US 2003/0071504 A1 Apr. 17, 2003

(30) Foreign Application Priority Data

May 4, 2000 (FR) ..... 00 05734

(51) Int. Cl.[7] ..... A47C 1/035

(52) U.S. Cl. ..... 297/423.3; 297/330; 297/423.36; 297/362.11

(58) Field of Search ..... 297/330, 423.3, 297/423.36, 362.11

(56) References Cited

U.S. PATENT DOCUMENTS 4,669,780 A * 6/1987 Sakakibara et al. ..... 297/257
5,352,020 A * 10/1994 Wade et al. ..... 297/423.26
5,467,002 A * 11/1995 Brooks ..... 318/553
5,560,681 A * 10/1996 Dixon et al. ..... 297/284.11
5,651,587 A * 7/1997 Kodaverdian ..... 297/423.36
6,194,853 B1 * 2/2001 Tual et al. ..... 318/266
6,227,489 B1 * 5/2001 Kitamoto et al. ..... 244/118.5
6,441,576 B1 * 8/2002 Marin-Martinod et al. ..... 318/568.1

FOREIGN PATENT DOCUMENTS

FR WO-9742050 * 11/1997
FR 2808175 * 4/2000
FR Wo-0125053 A1 * 4/2001
JP 11299570 * 11/1999

* cited by examiner

*Primary Examiner*—Peter M. Cuomo
*Assistant Examiner*—Joseph Edell
(74) *Attorney, Agent, or Firm*—Stites & Harbison PLLC; Douglas E. Jackson

(57) ABSTRACT

The method for controlling the dynamics applies to a seat (10) comprising at least three parts (16, 20, 22) which can move with respect to each other and at least two actuators (24, 26) for moving the three parts (16, 20, 22). The method comprises a step of operating the two actuators (24, 26) jointly to modify the configuration of the seat.

The step of joint operation comprises the following successive steps:

activating a first actuator (24) at a first instant; and activating a second actuator (26) at a second instant subsequent to the said first instant and separated from the first instant by a predetermined length of time.

9 Claims, 3 Drawing Sheets

METHOD FOR MANAGING THE CONTROL SYSTEM OF A SEAT WITH PRE-PROGRAMMED POSITIONS AND SEAT THEREFOR

The present invention relates to a method for controlling the dynamics of a seat comprising at least three seat parts which can move with respect to one another, and at least two actuators for moving the three parts with respect to one another, the method comprising a step of operating the two actuators jointly to modify the configuration of the seat.

Such a seat is used in particular in passenger aircraft.

To improve passenger comfort, many seats are equipped with electric actuating devices allowing the configuration of the seat to be modified by moving moving parts thereof.

It is common practice for each seat to comprise a back rest which can be inclined and which is articulated to one end of a seat cushion, and to comprise a leg rest which is articulated to the other end of the seat cushion. The back rest and the leg rest can both be moved, under the control of an individual electric actuator, between an essentially vertical position and an essentially horizontal position thus allowing the seat to adopt several configurations.

Furthermore, in order to increase the length of the leg rest, it is known practice for a foot rest, which can be moved in sliding with respect to the leg rest to be associated with the latter, this foot rest also being controlled by an electric actuator to move it with respect to the leg rest between the retracted position and a deployed position.

The seat advantageously comprises devices making it possible, through a single operation, to cause the leg rest, foot rest and possibly the back rest to move, this being so as to take the seat, from this single command, into a predetermined configuration in which each seat part has a predetermined position specific to the configuration considered.

For example, among these configurations are a lying configuration in which the back rest and the leg rest are both horizontal, the foot rest being deployed, and a sitting configuration in which the back rest and the leg rest are both essentially vertical, the foot rest then being in its retracted position.

Furthermore, each of the actuators associated with the various moving parts of the seat can be operated independently of the others, so that the seat can be converted by the passenger into numerous configurations which differ from the predetermined configurations.

When the passenger presses on a command allowing the seat to return to a predetermined configuration such as the lying position or the sitting position, the actuators are operated in succession so as to move the parts of the seat one after the other to their target position. The operation of one of these actuators is determined by the end of the operating phase of another actuator. Thus, at each moment, just one actuator is in motion.

It will be appreciated that successive operation of the various actuators makes the changing of the seat into the chosen predetermined configuration relatively lengthy.

It has been envisaged for all the actuators to be operated simultaneously. However, in this case, it is found that, depending on the speed specific to each actuator, certain parts of the seat may strike objects present in the immediate surroundings of the seat, such as a nearby seat or alternatively the floor of the aircraft. In addition, certain intermediate configurations of the seat as it moves into the target configuration may be extremely uncomfortable for the passenger.

The object of the invention is to propose a vehicle seat and a method for controlling its dynamics allowing the seat to be brought into predetermined configurations as quickly as possible without, however, undesirable intermediate configurations being adopted by the seat as it moves into the predetermined configuration.

To this end, the subject of the invention is a method for controlling the dynamics of a seat of the aforementioned type, characterized in that the said step of joint operation comprises the following successive steps:

activating a first actuator at a first instant; and activating a second actuator at a second instant subsequent to the said first instant and separated from the first instant by a predetermined length of time.

According to some particular embodiments, the method comprises one or more of the following features:

it comprises a step of detecting that the first actuator has stopped during the said predetermined length of time and a step of activating the second actuator as soon as it is detected that the first actuator has stopped;

the said step of joint operation of the two actuators is a step of bringing the seat into a predetermined configuration in which two of the moving parts are in predetermined positions specific to the said predetermined configuration;

the step of detecting that the first actuator has stopped comprises a step of detecting that the seat part operated by the first actuator has reached its predetermined position;

the seat comprises a seat cushion, a leg rest articulated to the seat cushion between a folded-back position and a deployed position, a foot rest that can move with respect to the leg rest between a retracted position and a deployed position, and two actuators arranged, one of them between the seat cushion and the leg rest, and the other one, between the leg rest and the foot rest, the phase of joint operation of the two activators being designed to move the leg rest into its deployed position and the foot rest into its deployed position, and the first actuator triggered at the said first instant is the actuator arranged between the seat cushion and the leg rest, and the second actuator triggered at the said second instant subsequent to the first instant is the actuator arranged between the leg rest and the foot rest;

the seat comprises a seat cushion, a leg rest articulated to the seat cushion between a folded-back position and a deployed position, a foot rest that can move with respect to the leg rest between a retracted position and a deployed position, and two actuators arranged, one of them between the seat cushion and the leg rest, and the other one, between the leg rest and the foot rest, the phase of joint operation of the two activators being designed to move the leg rest into its folded-back position and the foot rest into its retracted position, and the first actuator triggered at the said first instant is the actuator arranged between the leg rest and the foot rest, and the second actuator triggered at the said second instant subsequent to the first instant is the actuator arranged between the seat cushion and the leg rest; and the said predetermined length of time separating the first and second instants is set to make sure that the foot rest does not strike the floor over which the seat is installed when the seat configuration is being modified.

Another object of the invention is a vehicle seat comprising at least three seat parts which can move with respect to one another, and at least two actuators for moving the three parts with respect to one another, and means for operating the two actuators jointly to modify the configuration of the seat, characterized in that the said joint operating means comprise:

means for actuating a first actuator at a first instant; and means of actuating a second actuator at a second instant subsequent to the said first instant and separated from the first instant by a predetermined length of time.

As a preference, the said joint operating means comprise means of detecting that the first actuator has stopped during the said predetermined length of time and means of actuating the second actuator as soon as it is detected that the first actuator has stopped.

The invention will be better understood from reading the description which will follow, which is given solely by way of example and made with reference to the drawings in which.

Figure 1:
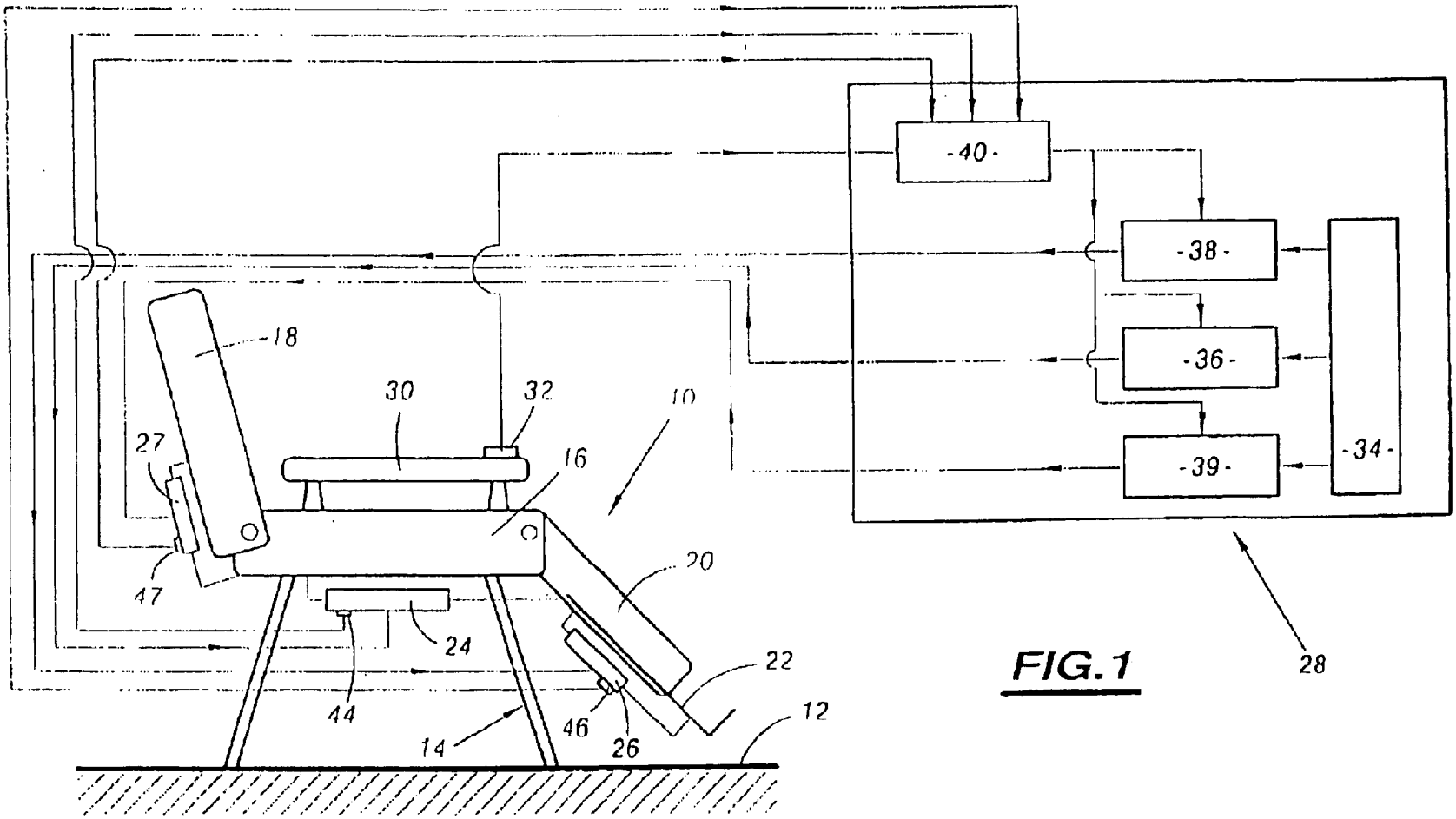
FIG. 1 is a schematic view of a vehicle seat according to the invention.

The seat 10 depicted in FIG. 1 is an aircraft passenger seat. This seat is fixed to the floor 12 of the aircraft.

The seat 10 comprises an underframe 14 secured to the floor 12 on which there rests a roughly horizontal seat cushion 16. Articulated to one end of the seat cushion is a backrest 18 that can be moved between a roughly vertical up position and a roughly horizontal folded-down position.

Articulated to the other end of the seat cushion 16 is a leg rest 20 that can be moved between a roughly vertical position folded back under the seat cushion 16 and a roughly horizontal deployed position in the continuation of the seat cushion 16.

The seat 10 further comprises a foot rest 22 mounted so that it can move in sliding with respect to the leg rest 20 in the continuation thereof.

The leg rest 22 can be moved between a position in which it is retracted inside the leg rest 20 and a deployed position in which it continues the latter and is practically completely out.

A first electric actuator 24 is mounted between the seat cushion 16 and the leg rest 20 so as to move the latter between its folded-back position and its deployed position.

Likewise, a second actuator 26 is provided between the leg rest 20 and the foot rest 22 so as to move the foot rest between its retracted position and its deployed position.

A third actuator 27 is mounted between the seat cushion 16 and the back rest 18 so as to move the back rest between its up position and its folded-back position.

The three actuators operate at constant speeds which may differ from one actuator to the next.

Each of the three actuators 24, 26 and 27 is supplied with electrical current from a central control unit 28. This control unit is connected separately to each of the actuators 24, 26 and 27 so as to control them independently.

Furthermore, the seat comprises an arm rest 30, to which a keypad 32 is fixed, allowing independent control of the actuators 24, 26 and 27 so as to cause them to move.

The keypad 32 also has keys allowing the passenger, through a single command acting on several actuators, to achieve one of two predetermined configurations. The number of predetermined configurations that the seat has may be reduced to one or may exceed two.

In the example considered, the keypad 32 has two buttons each associated with a predetermined configuration. These configurations are a sitting configuration and a lying configuration.

In the sitting configuration, the leg rest 20 and the back rest 18 are both in predetermined positions in which they are roughly vertical and make an angle of 90° with the plane of the seat cushion. In this sitting configuration, the foot rest 22 is retracted up inside the leg rest 20.

In the lying configuration, the leg rest 20 and the back rest 18 are in predetermined positions in which they continue the seat cushion 16 and thus lie roughly in the plane thereof. In this lying configuration, the foot rest 22 is in its deployed position.

The unit 28 comprises a source 34 for powering the actuators. The source is formed, for example, of a Transformer connected to the overall aircraft electrical supply system by appropriate connecting means.

For each actuator there is a supply interface 36, 38 and 39 powering the actuators 24, 26 and 27 respectively from the supply source 34. These interfaces shape the actuator supply current according to the desired direction of actuation.

The supply interfaces 36, 38 and 39 are controlled by a data processing unit 40. This unit 40 is connected to the control keypad 32 so as to gather the commands from the passenger.

The data processing unit 40 comprises, for example a microprocessor capable of running a suitable program described later on in the description.

The unit 40 also comprises a clock allowing the microprocessor to manage one or more timers so that the triggering of the movement of the various actuators can be staggered.

Finally, each actuator 24, 26 and 27 is equipped with one or more position sensors making it possible to detect that the actuator is in a position such that the seat element it controls is reaching a position suited to a predetermined seat configuration.

These sensors, denoted by the references 44, 46 and 47 respectively in the case of the actuators 24, 26 and 27, are connected to the data processing unit 40. Thus, the unit 40 is informed when one of the actuators is in a position such that the element it operates is in the position it should occupy for the desired predetermined configuration.

These sensors are formed, for example, of potentiometers or microcontacts embedded between the fixed and moving parts of the actuators.

For the seat to operate, the data processing unit 40 runs a program known per se designed to control the supply interfaces 36, 38 and 39 so that these power the actuators 24, 26 and 27 in one direction or in the other by reversing the direction of the current, according to the data received from the unit 40.

Figure 2:
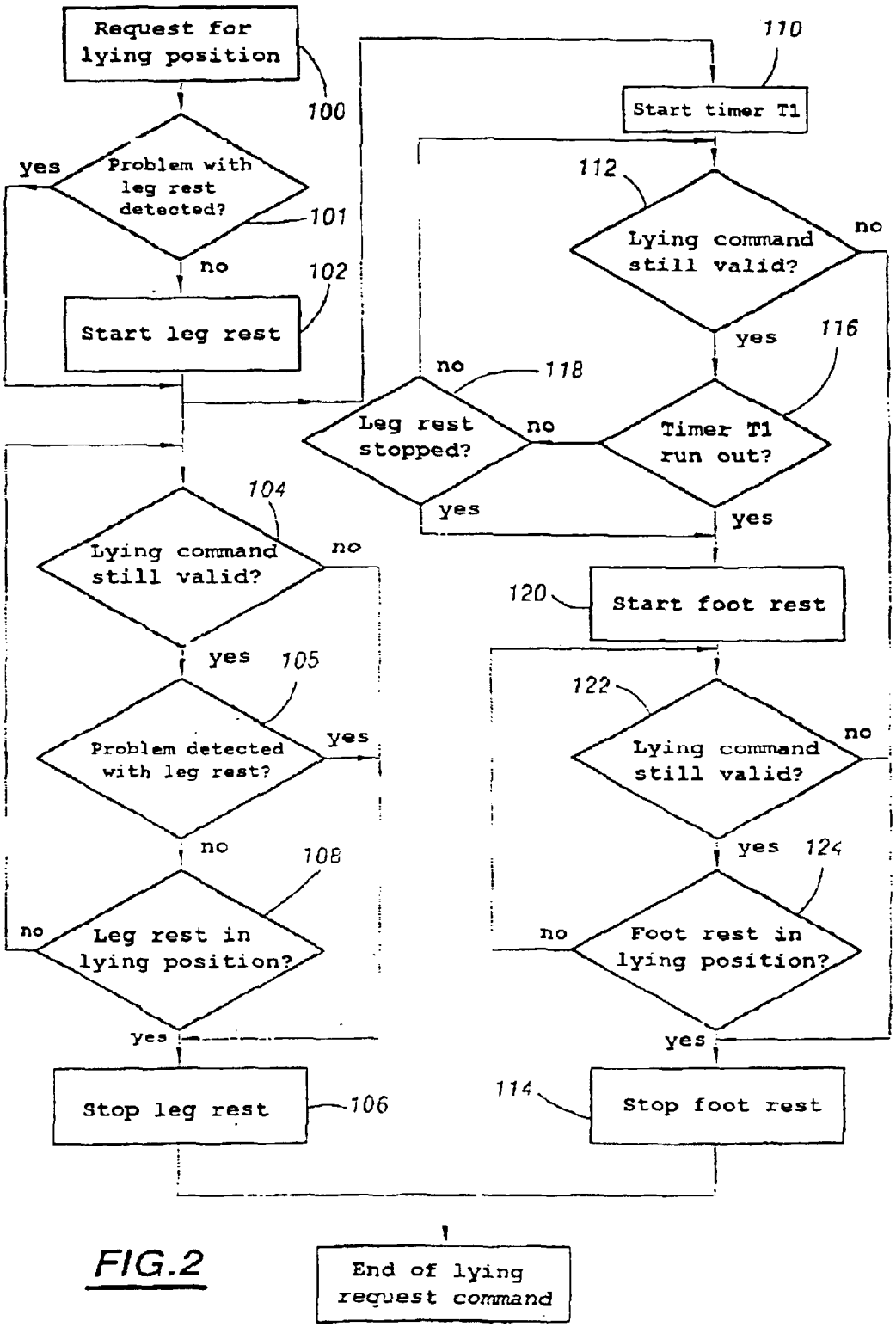
FIG. 2 is a flowchart explaining the operation of the seat by implementing a method for managing its dynamics according to the invention.

FIG. 2 depicts the algorithm of the routine run by the data processing unit 40 so as to bring the seat into its lying configuration.

During this modification to the configuration of the seat, the back rest is brought into its folded-back position as soon as the passenger depresses the key on the keypad 32 which is devoted to this Particular configuration of the seat. At the same time, as this key is depressed, the routine, the algorithm of which is given in FIG. 2, is run.

Thus, upon detection that this key has been depressed, in step 100, a first test step is carried out in step 101 to determine whether there is a detected problem with the leg rest or more precisely with the actuator 24 that controls the leg rest. This problem may, for example, be malfunctioning of the potentiometer of the actuator supplying an erroneous value or any other type of problem which may be detected by the data processing unit 40. If no problem is detected, the actuator 24 that controls the leg rest is immediately put into operation in step 102. If a problem is detected, step 102 is omitted.

As illustrated in the left-hand branch of the flowchart, a test is then performed in step 104 to check that the button commanding the lying position is still being depressed by the passenger. Step 105 also checks that no problem is detected with the leg rest. If either of these conditions is not satisfied, the actuator 24 for the leg rest is stopped in step 106. As long as the command to bring the seat into the lying configuration is sustained by the passenger, the data processing unit 40 scrutinizes the sensor installed on the leg rest actuator 24 in step 108 to determine whether or not the leg rest is in the target position it occupies with respect to the seat cushion when the seat is in its lying configuration. As long as this position is not achieved, the tests in steps 104, 105 and 108 are performed. When the leg rest has been brought into its target position, the stopping of the leg rest is commanded at step 106.

Furthermore, and as illustrated in the right-hand branch of the flowchart of FIG. 2, immediately after the actuator which moves the leg rest has been started in step 102, or on completion of step 101, if a problem has been detected, a timer is tripped in step 110. This timer runs for a predetermined time denoted T1. This time is set experimentally according to the nature and structure of the seat. It is, for example, equal to one second.

Next, step 112 checks that the command for the lying position is still sustained on the keypad 32. If it is not, the actuator 24 controlling the leg rest is stopped in step 114 if the latter was already moving.

By contrast, if the command for the lying configuration is still being sustained by the passenger, step 116 checks that the timer started at step 110 has not run out. If it has not run out, the data processing unit 40 in step 118 determines whether the actuator 24 has stopped, either because the leg rest 24 has reached its target lying position, or because a problem has been detected in one or other of steps 102 and 105. If neither is the case, the tests of steps 112 and 116 are performed again.

If, in step 116, the unit 40 finds that the timer has run out or if, in step 118, it is found that the actuator 24 has stopped, the starting of the actuator 26 controlling the foot rest is initiated at step 120. In the latter case, the actuator 26 is started before the timer T1 has run out.

It will be appreciated that unless the leg rest is in its target position and the actuator controlling it has therefore stopped before the time T1 has run out, the actuator 26 controlling the foot rest is not triggered until a time T1 after the triggering of the actuator 24 that controls the leg rest.

After step 120 of setting the foot rest 22 in motion, step 122 checks that the command for the lying configuration is still valid. If it is not, the actuator 26 controlling the foot rest is stopped in step 114. If it is, the data processing unit 40 in step 124 checks the condition of the position sensor for the position of the actuator 26 controlling the foot rest so as to check whether or not the foot rest 22 is occupying its target position specific to the lying configuration of the seat. If it is, the stopping of the actuator 26 controlling the root rest is commanded at step 114. As long as the command for the lying configuration is still validated, and the foot rest is not in its target position, steps 122 and 124 are performed.

Figure 3:
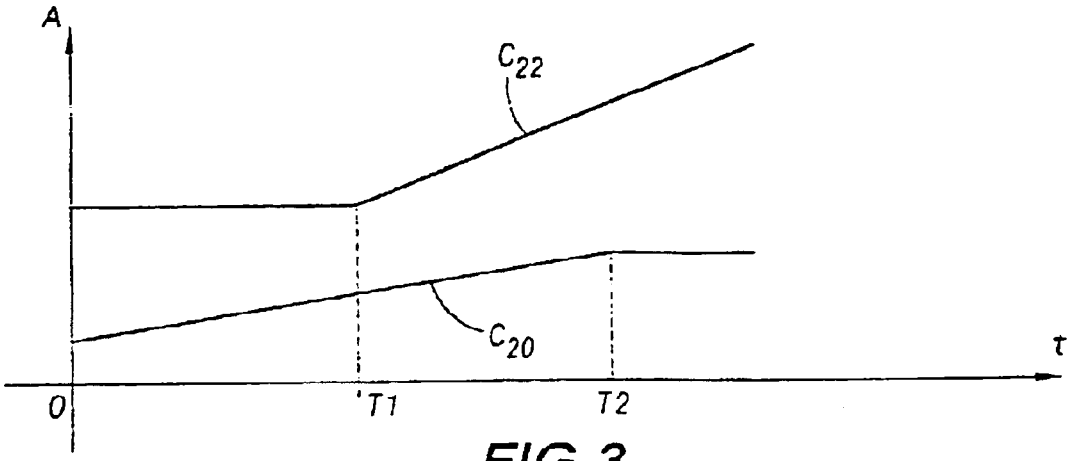
FIGS. 3 and 4 are curves illustrating the movement of two actuators of the seat as a function of time during implementation of the method for controlling the dynamics of the seat according to the invention.

FIG. 3 schematically depicts the combined movement of the leg rest 20 and of the foot rest 22 when the algorithm of FIG. 2 is being run.

In this figure, the time t is given along the x-axis while the amplitude A of displacement of the actuators is given along the y-axis. The curve of the displacement of the leg rest is denoted by $C_{20}$ and the curve of the displacement of the foot rest is denoted by $C_{22}$.

It can be seen that running the algorithm causes immediate starting of the leg rest at the instant 0. If the leg rest 20 is initially a long way away from its target position defined for the chosen predetermined configuration, the movement of the leg rest takes place over a period of time that exceeds the period of time T1 defined by the timer. Thus, the leg rest 20 does not reach its target position until an instant T2 after T1, which means that the condition of step 108 allowing the leg rest actuator 24 to stop at step 106 is not satisfied until after the timer initiated at step 110 has run out. Thus, the test performed in step 116 is satisfied at the instant T1, which means that the actuator 26 for moving the foot rest is initiated only at the instant T1, the latter being kept stationary during the initial phase of operation of the leg rest.

When this is the case, it is found that the start of movement of the foot rest with respect to the leg rest is triggered with a delay T1 after the start of the movement of the leg rest with respect to the seat cushion. By imposing such a delay, it is possible to make sure that the leg rest is already raised enough to allow the foot rest to be deployed without the risk of the free end of the latter striking the ground as it comes out.

The length T1 of the time delay is determined so that when the leg rest is initially in its extreme position, that is to say its folded-back position, and the movement of the seat towards its lying configuration is commanded, then the delay T1 is long enough to ensure that the foot rest does not touch the floor during the simultaneous movement of the leg rest and of the foot rest, even if the speed at which the foot rest travels is very much higher than the rate of movement of the leg rest.

Figure 4:
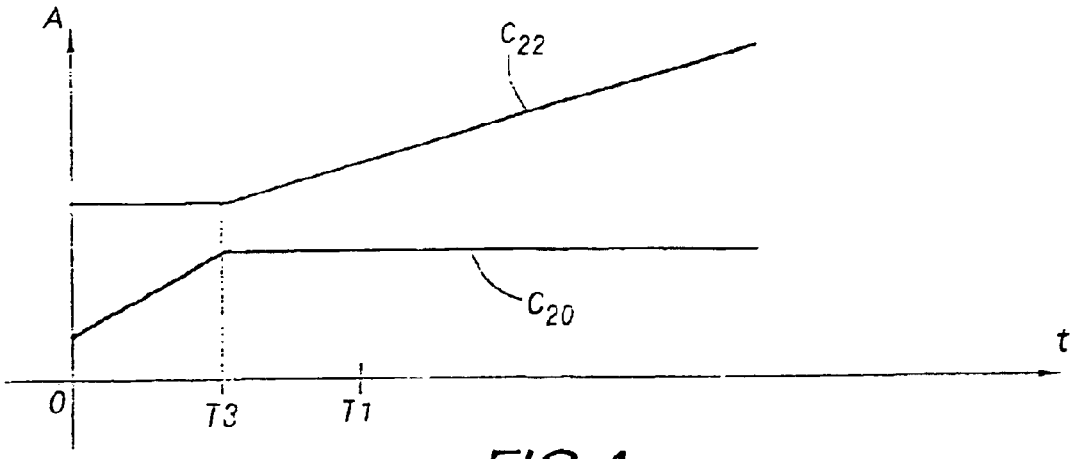

FIG. 4 illustrates, on a graph identical to the one of FIG. 3, the displacement of the foot rest and of the leg rest when the seat is brought into its lying configuration while the leg rest is initially in a position very close to its deployed position. In this case, the running of the algorithm of FIG. 2 first of all causes the leg rest to start and move towards its deployed position which it reaches at an instant T3 prior to the instant T1 at which the timer initiated at step 110 runs out. Thus, the condition in step 118 is satisfied before the running-out of the timer checked at step 116. As soon as the actuator 24 controlling the leg rest stops, the actuator 26 controlling the foot rest is initiated to bring the foot rest into its deployed position.

Likewise, when the seat is brought into its sitting configuration, the movement of the actuators 24 and 26 are also synchronized by employing a predetermined delay between the instants at which they are starter, so as to prevent the foot rest from striking the floor. In this case, the actuator 26 controlling the foot rest is first of all initiated to retract the foot rest, then only after a timer has run out. Is the actuator 24 controlling the leg rest initiated in order to fold the leg rest back. If the foot rest reaches its retracted position and therefore the actuator controlling it ceases to operate before the timer has run out, then the actuator 24 is initiated immediately, before the timer runs out.

The method for controlling the dynamics which is described here can also be used for the joint control of just two seat parts, without this control having the objective of bringing the seat parts into a predetermined configuration.

Thus, for example, one of the buttons on the keypad may be intended for moving the leg rest and the foot rest, at least partially simultaneously, this button, when depressed, causes the leg rest and the foot rest to move both at the same time towards their extreme position with, according to the invention, a staggering of the instants at which the actuators start. In this case, the movement of the actuators does not cease until these reach their extreme positions or until the user releases the control button.

What is claimed is:

1. A method for controlling the dynamics of a seat comprising at least three seat parts which can move with respect to one another, and at least two actuators for moving the three parts with respect to one another, the method comprising a step of operating the two actuators jointly to modify the configuration of the seat, said operating step comprising the following successive steps:

activating a first actuator at a first instant; and activating a second actuator at a second instant subsequent to the first instant and separated from the first instant by a fixed predetermined length of time which is independent of initial conditions of the three seat parts.

2. The method as claimed in claim 1, further comprising a step of detecting that the first actuator has stopped during the predetermined length of time, and a step of activating the second actuator as soon as said step of detecting detects that the first actuator has stopped.

3. The method as claimed in claim 1, wherein said operating step is a step of bringing the seat into a predetermined configuration in which two of the moving parts are in predetermined positions specific to the predetermined configuration.

4. The method as claimed in claim 3, further comprising a step of detecting that the first actuator has stopped during the predetermined length of time and a step of activating the second actuator as soon as said step of detecting detects that the first actuator has stopped, and wherein the step of detecting that the first actuator has stopped comprises a step of detecting that the seat part operated by the first actuator has reached the predetermined position thereof.

5. The method as claimed in claim 3, in which the seat comprises a seat cushion, a leg rest articulated to the seat cushion between a folded-back position and a deployed position, a foot rest that can move with respect to the leg rest between a retracted position and a deployed position, and two actuators arranged, one of them between the seat cushion and the leg rest, and the other one, between the leg rest and the foot rest, in which said step of operating the two actuators jointly is designed to move the leg rest into the deployed position thereof and the foot rest into the deployed position thereof, wherein the first actuator triggered at the first instant is the actuator arranged between the seat cushion and the leg rest, and the second actuator triggered at the second instant subsequent to the first instant is the actuator arranged between the leg rest and the foot rest.

6. The method as claimed in claim 5, wherein the predetermined length of time separating the first and second instants is set to make sure that the foot rest does not strike the floor over which the seat is installed when the seat configuration is being modified.

7. The method as claimed in claim 3, in which the seat comprises a seat cushion, a leg rest articulated to the seat cushion between a folded-back position and a deployed position, a foot rest that can move with respect to the leg rest between a retracted position and a deployed position, and two actuators arranged, one of them between the seat cushion and the leg rest, and the other one, between the leg rest and the foot rest, in which said step of operating the two actuators jointly is designed to move the leg rest into the folded-back position thereof and the foot rest into the retracted position thereof, wherein the first actuator triggered at the first instant is the actuator arranged between the leg rest and the foot rest, and the second actuator triggered at the second instant subsequent to the first instant is the actuator arranged between the seat cushion and the leg rest.

8. A seat comprising at least three seat parts which can move with respect to one another, and at least two actuators for moving the three parts with respect to one another, and operating means for operating the two actuators jointly to modify the configuration of the seat, said operating means comprise:

means for actuating a first actuator at a first instant; and means of actuating a second actuator at a second instant subsequent to the said first instant and separated from the first instant by a fixed predetermined length of time which is independent initial conditions of the three seat parts.

9. The seat as claimed in claim 8, wherein said operating means comprise means of detecting that the first actuator has stopped during the predetermined length of time, and means of actuating the second actuator as soon as said means of detecting detects that the first actuator has stopped.

* * * * *